US007347075B2

(12) United States Patent
Vescovini

(10) Patent No.: US 7,347,075 B2
(45) Date of Patent: Mar. 25, 2008

(54) METHODS FOR THE COLD EXTRUSION OF METALLIC ELEMENTS WITH DEAD OR THROUGH HOLES AND PLANT FOR CARRYING OUT SAID METHODS

(75) Inventor: Alessandro Vescovini, Monfalcone (IT)

(73) Assignee: Amafa Service S.R.L. (IT)

( * ) Notice: Subject to any disclaimer, the term of this patent is extended or adjusted under 35 U.S.C. 154(b) by 154 days.

(21) Appl. No.: 10/501,104

(22) PCT Filed: Feb. 26, 2003

(86) PCT No.: PCT/IT03/00106

§ 371 (c)(1),
(2), (4) Date: Dec. 17, 2004

(87) PCT Pub. No.: WO2004/043626

PCT Pub. Date: May 27, 2004

(65) Prior Publication Data

US 2005/0145004 A1 Jul. 7, 2005

(30) Foreign Application Priority Data

Nov. 12, 2002 (IT) ..... VR2002A0118

(51) Int. Cl.
*B21D 53/24* (2006.01)
*B21D 43/05* (2006.01)
*B21K 1/68* (2006.01)

(52) U.S. Cl. ..... 72/340; 72/356; 470/25; 470/89; 470/91; 470/109

(58) Field of Classification Search ..... 72/334, 72/355.2, 355.6, 356, 340; 470/91, 106, 470/100, 109, 89, 25
See application file for complete search history.

(56) References Cited

U.S. PATENT DOCUMENTS

| | | | | | |
|---|---|---|---|---|---|
| 1,714,316 | A | * | 5/1929 | Oakley | 470/25 |
| 2,149,578 | A | * | 3/1939 | Carney | 470/91 |
| 2,272,758 | A | * | 2/1942 | Wilcox et al. | 470/139 |
| 2,361,770 | A | * | 10/1944 | Huck | 470/29 |
| 2,689,360 | A | * | 9/1954 | Ware | 470/89 |
| 2,832,973 | A | | 5/1958 | MacDonald et al. | |
| 2,871,492 | A | | 2/1959 | Sciullo et al. | |
| 3,065,661 | A | * | 11/1962 | Kolec et al. | 411/41 |
| 3,759,080 | A | | 9/1973 | Sugahara et al. | |
| 4,048,825 | A | | 9/1977 | Dastrup et al. | |
| 4,175,417 | A | * | 11/1979 | Vergnani et al. | 72/356 |
| 4,227,394 | A | * | 10/1980 | Heimel | 72/356 |
| 4,272,978 | A | * | 6/1981 | Berecz | 72/335 |

(Continued)

FOREIGN PATENT DOCUMENTS

GB 713472 8/1954

*Primary Examiner*—Daniel C Crane
(74) *Attorney, Agent, or Firm*—Greenberg Traurig, LLP

(57) ABSTRACT

Cold extrusion procedures for obtaining metal elements such as for example bushings, nuts or other elements with dead or through holes, screws, standard and special shape extruded or pressed products, etc. on a machining center comprising a series of hydraulic presses connected to each other with an automatic movement system. The final drilling or shearing of the elements is advantageously carried out by a dedicated drilling or shearing unit, working at high speed, which can consist of a vertical mechanical press. The use of the plant comprising several hydraulic presses together with the rapid drilling or shearing unit makes it possible to achieve a high level of productivity.

30 Claims, 4 Drawing Sheets

U.S. PATENT DOCUMENTS 4,291,568 A * 9/1981 Stifano, Jr. ..... 72/356
4,404,830 A * 9/1983 Koch ..... 72/128
4,449,390 A * 5/1984 Pontini ..... 72/405.09
4,882,924 A * 11/1989 Kohama et al. ..... 72/254
5,354,383 A * 10/1994 Bianchi ..... 134/3
5,632,175 A * 5/1997 Green et al. ..... 72/130
6,098,436 A 8/2000 Girardello et al.
6,571,452 B1 * 6/2003 Wang ..... 29/557
6,775,908 B2 * 8/2004 Ohara et al. ..... 29/888.1
2002/0005078 A1 1/2002 Krause

* cited by examiner

METHODS FOR THE COLD EXTRUSION OF METALLIC ELEMENTS WITH DEAD OR THROUGH HOLES AND PLANT FOR CARRYING OUT SAID METHODS

TECHNICAL FIELD

The present invention concerns procedures for the cold extrusion on hydraulic presses of metal elements.

More specifically, the present invention refers to cold extrusion procedures for the production of metal elements such as for example bushings, nuts or other elements with dead or through holes, screws, standard and special shape extruded or pressed products, etc.

These cold extrusion procedures can be carried out by means of a plant comprising a series of hydraulic presses connected to each other with an automatic movement system and the resulting products generally consist of bushings, nuts or other elements with dead or through holes, screws, standard and special shape extruded or pressed products, etc. made from steel, regardless of the type and resistance class of the steel, or from other metal materials (aluminium, copper, brass) with an external diameter indicatively greater than 30 mm.

The present invention can be applied in the mechanical industry sector for the production of medium-high quantity batches.

BACKGROUND ART

It is known that the production of tubular metal elements such as, for example, bushings substantially takes place according to four possible procedures:

- cold pressing using horizontal mechanical presses;
- cold or hot pressing using vertical mechanical presses and subsequent lathe machining;
- turning of a previously rolled tube;
- removal of shavings starting from a full blank.

Cold pressing using multistation horizontal presses foresees the absorption of a considerable pressing power to achieve a thrust of around 1200 tons necessary to carry out the machining. These horizontal presses involve a very high investment cost to achieve a high level of productivity which can reach 40 pieces a minute.

The great speed of the machining process, consisting substantially of an extrusion operation, causes an increase in the temperature of the piece which can exceed 700 degrees. This temperature exceeds the tempering temperature of all the types of steel used to construct extrusion tools and punches with evident problems regarding the short life of these instruments. Experience shows that this problem is very evident above all in the pressing of pieces with a diameter greater than 30 mm.

Another disadvantage is represented by the fact that the tolerances relative to the longitudinal dimensions of the pieces are extremely high, at least as regards parts which require a certain precision, such as for example the bushings used for connecting rods which require tolerances of around 0.3 mm.

As far as single-station vertical presses are concerned, the production procedure for tubular elements foresees pressing in subsequent but not sequential phases, to achieve the various deformation stages of the piece.

Between one stage and the next, due to the considerable work hardening of the fibres of the rough-shaped material, it is necessary to carry out several heat treatment cycles consisting substantially of annealing.

One disadvantage is represented by the fact that this sequence of treatments has a considerable effect on the pieces as well as requiring, for each stage, lubrication of the pieces (phosphate coating) which prolongs the overall time needed to obtain the finished piece.

Another drawback is represented by the fact that, in this case too, it is extremely difficult to maintain the tolerances and the life of the tools is totally unsatisfactory again because of the high machining speed.

This processing by means of single-station vertical presses also requires final turning with a further increase in costs.

As far as hot pressing is concerned, maintaining the required tolerances and tool wear represent even more serious problems than those foreseen in the previous machining processes making this procedure uncompetitive, due also to a final stage on machine tools.

As regards rolled tube turning, this is the most commonly used procedure for bushings with an external diameter less than or equal to 50 mm. The tube, rolled by the steel works in 3-5 meter bars, is cut to size and transported to a machining centre which, by removal of the shavings, forms the external radii and the two entrances.

One drawback is represented by the fact that the raw material forming the tube costs 60-70% more than the 'full' steel that can be used in the other processes described above.

As regards turning starting from a blank, this process is used for bushings with an external diameter greater than 50 mm, rolled tubes of these dimensions not being available on the market.

This procedure requires the use of automatic lathes which produce pieces with a good frequency (approx. 1 every 30 seconds).

One disadvantage is represented by the fact that there is a very high rate of material wastage: around 50-55% of the original blank.

Another procedure for obtaining tubular elements consists of drawing, starting from a flat piece which is then deformed and finally finished on the machine tools.

In this case too the fibres of the material undergo considerable work hardening, altering and degrading the mechanical features of the finished product.

There is also a very high rate of production rejects, considerably increasing the costs of the finished product.

The patent U.S. Pat. No. 6,098,436 (Girardello) describes a method for the machining of metals to obtain tubes of different dimensions and for different uses, made from steel with a carbon content of between 0.10% and 0.50%, with strict tolerances.

This method foresees the use, as a starting material, of a round bar of hot rolled steel which is then cut in order to obtain at least one block which is drilled and subjected to chemical treatment. The block is then pressed and, if necessary, subjected to final turning and a heat treatment in order to obtain a finished product such as a hydraulic or oleopneumatic cylinder or a container for high pressure filters or a tube for high pressure, or a bearing, using a limited quantity of steel.

DESCRIPTION OF THE INVENTION

This invention proposes to provide a first procedure for obtaining metal elements such as for example bushings, nuts or other products with dead or through holes, etc., which can eliminate or significantly reduce the drawbacks described above.

This invention also proposes to provide a second procedure for obtaining metal elements such as for example screws, standard or special shape extruded or pressed products, etc., with a diameter greater than 30 mm, which can be easily produced in order to be economically advantageous.

According to a first aspect, the procedure for obtaining tubular metal elements such as for example bushings, nuts or other products with dead or through holes, etc., according to the invention, foresees:

- setting up and preparation of a blank in rolls or bars of full metal material;
- straightening in the case of rolls and cutting of the metal material into pieces of a determined length;
- pressing in sequence achieved by passing these pieces sequentially through a number of hydraulic presses in order to obtain a blank presenting one or two dead holes longitudinally opposite each other separated by a central transverse section;
- in some cases, for products with through holes, the drilling of the central transverse section can be achieved by the action of a mechanical press.

According to a second aspect, the procedure for obtaining metal elements such as for example screws, standard or special shape extruded or pressed products, etc., with a diameter indicatively greater than 30 mm, according to this invention, comprises:

- setting up and preparation of a blank in rolls or bars of full metal material;
- straightening and in the case of rolls and cutting of the metal material into pieces of a determined length;
- pressing in sequence achieved by passing these pieces sequentially through a number of hydraulic presses in order to obtain a series of blanks;
- if necessary, shearing which, for hexagonal-head screws for example, can be achieved through the action of a mechanical press.

According to the invention, both procedures consist of sequential cold pressing on a number of hydraulic presses of sections of steel or other material to obtain pieces of various shapes and sizes with diameters indicatively greater than 30 millimeters.

Advantageously the setting up and preparation of the blank differ according to the material used.

The plant used advantageously consists of a number of hydraulic presses connected by means of a transfer unit designed to move the pieces being machined. The transfer unit comprises a series of manipulator gripper robots powered by a hydraulic, mechanical or pneumatic source of energy as necessary.

The drilling or shearing are advantageously carried out by the intervention of a dedicated drilling or shearing unit, working at high speed, which can consist of a vertical mechanical press.

The use of the plant consisting of several hydraulic presses together with the rapid drilling or shearing unit allows a high level of productivity.

DESCRIPTION OF THE DRAWINGS

Other features and advantages of the invention will become evident on reading the following description of a form of embodiment of the invention, given as a non-binding example, with the help of the enclosed drawings, in which.

DESCRIPTION OF ONE EMBODIMENT OF THE INVENTION

Figure 1:
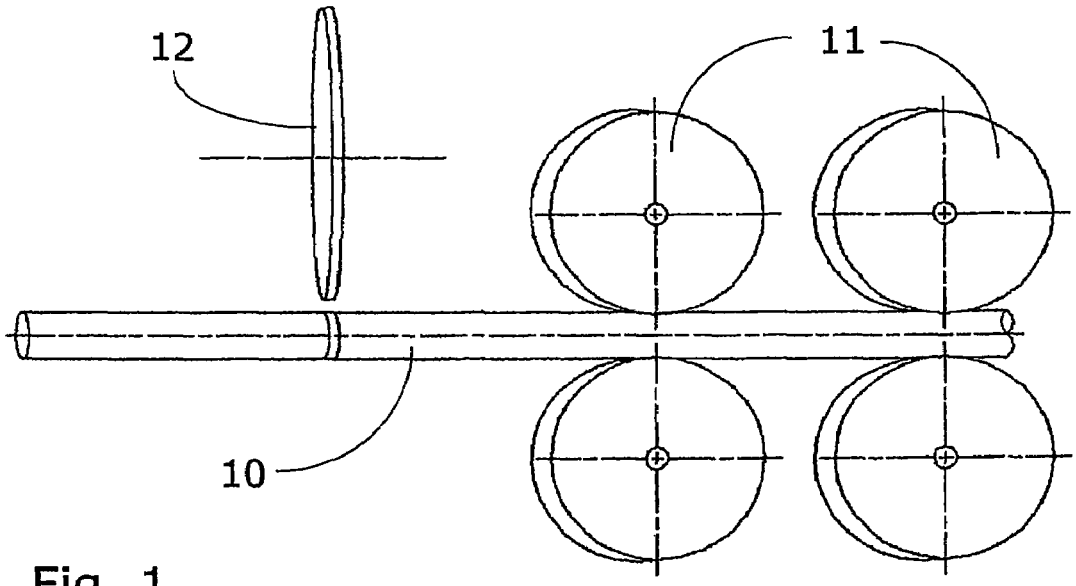
FIG. 1 shows an elevated side view of a straightening unit to be applied if rolls are used, and an example of a cutting unit to carry out part of the procedure according to the invention.

The procedures for obtaining metal elements according to the invention comprise both the setting up and preparation of a blank in rolls or bars of full metal material of various shapes such as for example round, square, rectangular, etc., the straightening in the case of rolls and the cutting of the metal material into pieces of a determined length.

The procedure for obtaining drilled elements such as for example bushings, nuts or other elements with dead or through holes etc. then foresees the pressing in sequence achieved by passing these pieces sequentially through a number of hydraulic presses in order to obtain a series of blanks each of which can present one or two dead holes longitudinally opposite each other separated by a central transverse section; in some cases, for products with through holes, the drilling of the central transverse section can be achieved by the action of a mechanical press.

According to the invention, the material initially in rolls or in bars is prepared in different ways depending on the initial chemical composition of the material.

In particular the preparation cycles can differ according to whether the material is stainless steel (or steel in any case containing high percentages of chrome and nickel) or a low-alloy steel typically casehardened or hardened and tempered or subjected to other specific cycles depending on the raw material specifically requested by the customer.

In the first case the material is advantageously treated by solution annealing and pickled in a balanced solution of sulphuric acid, hydrofluoric acid, potassium permanganate and hydrogen peroxide.

The material is then washed repeatedly by means of immersion in a salting tank in order to facilitate the pressing.

If a low-alloy steel is used, the material is pickled in sulphuric acid for 10 to 15 minutes and then washed by immersion in a phosphating tank in which, by chemical reaction, a layer of zinc phosphate is created on the surface of the piece.

On completion of this stage the material is washed again by immersion in a sodium stearate tank where, again by chemical reaction, a thin layer of zinc stearate forms on top of the previous layer of zinc phosphate.

Other specific cycles can be carried out, according to the raw material specifically requested by the customer, and adapted to the new process as per this invention.

If a roll is used, the previously washed metal material is straightened by loading it on a wire-straightening unit designed to unroll the skein. The free end of the roll is pulled through a first set of rollers and then through a system of opposite rollers designed to straighten the wire and transfer it to a cutting unit.

The material is then cut into pieces of a predetermined length by a number of possible procedures such as for example mechanical or hydraulic processes by means of one or more mobile blades or in the traditional way by a circular saw which acts in synchronisation with the previously described wire-straightening units in the case of rolls.

Figure 4:
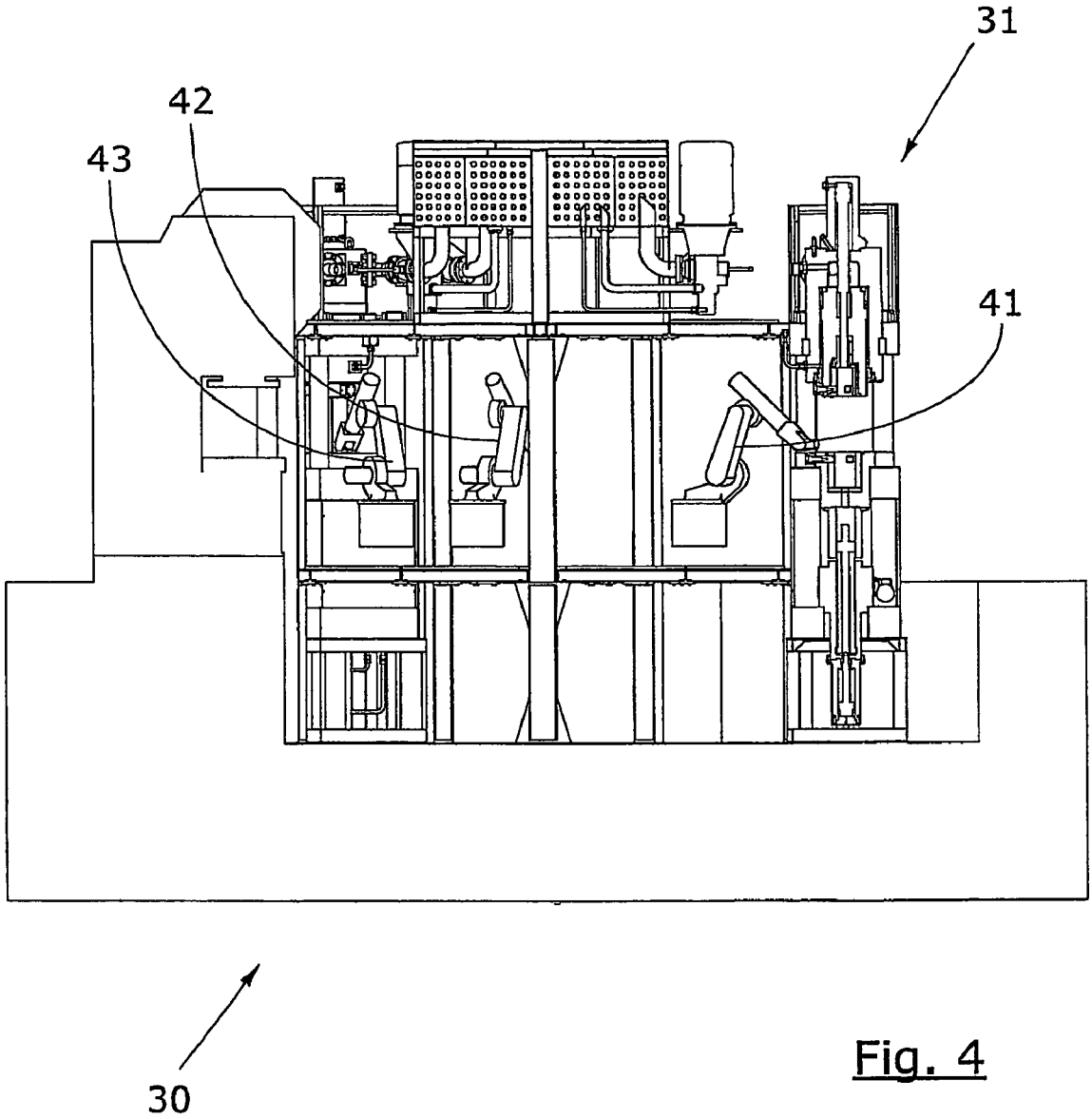
FIG. 4 represents a schematic side view partially in cross-section of a plant comprising a plurality of presses according to the invention.
Figure 5:
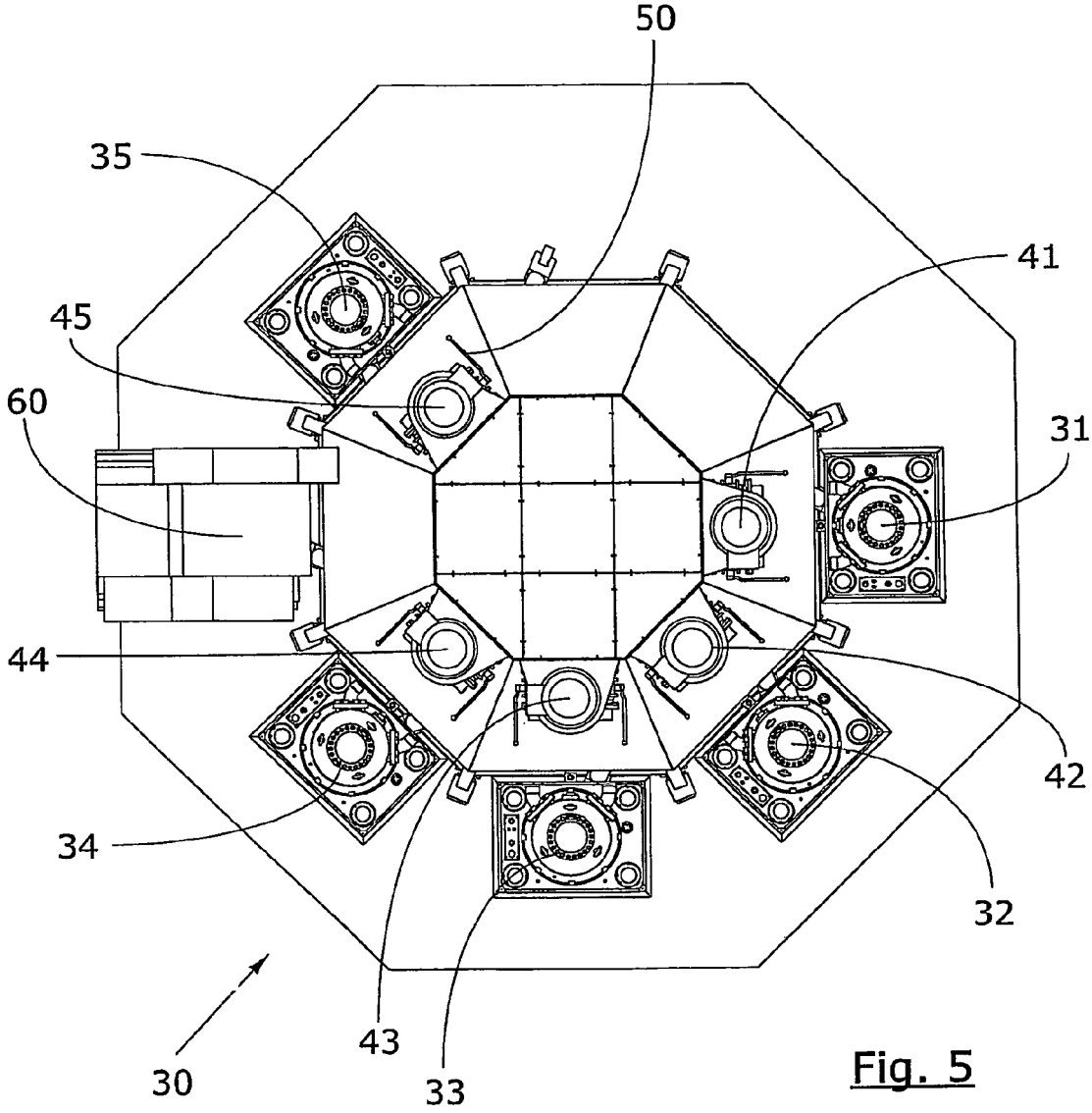
FIG. 5 represents a schematic plan view of a plant comprising a plurality of presses according to the invention.

With reference to FIGS. 4 and 5, the pieces of material to be machined constitute the blanks to be transferred to a pressing unit consisting of a machining centre 30 comprising, for example, a series of hydraulic presses 31, 32, 33, 34, 35.

Each individual press can be equipped with the power to guarantee the thrust necessary for the cold extrusion of the blanks and the system for the approach and upward movement of the punch will have an extremely high speed in order to increase the productivity of the machining centre.

In order to move the pieces from one press to another the procedure foresees the use of a transfer unit which can consist of a series of manipulator robots 41, 42, 43, 44, 45 comprising steel grippers 50 connected together and powered by a hydraulic, mechanical or compressed-air device as required.

The individual grippers 50 can transfer each blank from one press to another and, if required by the pressing cycle, rotate the blank at various angles during the transfer.

The individual stations of the plant consisting of a plurality of presses 30 can be equipped with extraction units, in their lower part near the bed face and near the pressing cylinder. These extraction units can consist of small hydraulic linear actuators or another mechanical or pneumatic system as required.

The functioning and synchronisation of the individual presses and of the transfer unit are advantageously controlled by a PLC or a microprocessor as necessary.

It is also possible to equip the plant with a mechanical drilling or shearing unit 60 consisting, for example, of a vertical mechanical press, working from the bottom upwards or vice versa, as required.

In the case of drilled products the punch of this press is designed to eject the transverse section or plug from the blank, which was left by the previous pressing and extrusion stage carried out on the machining centre by the various hydraulic presses.

In the case of sheared products, the shearing die of this press is designed to eject the excess material from the blank which was left by the previous pressing and extrusion stage carried out on the machining centre.

Advantageously, the drilling or shearing unit 60 can be equipped with wheels so that it can be moved and applied indifferently to each pressing station from which the hydraulic extraction cylinder can be easily removed.

With reference to FIG. 1, which refers to starting material in roll form, it can be noted that the blank 10 consisting of a full bar, once unrolled from a skein (not shown in the drawings), is pulled through trains of opposite rollers 11 designed to straighten the material.

The bar in this example of a full rod 10 is then pulled towards a cutting unit, for example consisting of a circular saw 12, which produces sections that can be subsequently processed by the machining centre consisting of a number of hydraulic presses.

Figure 2:
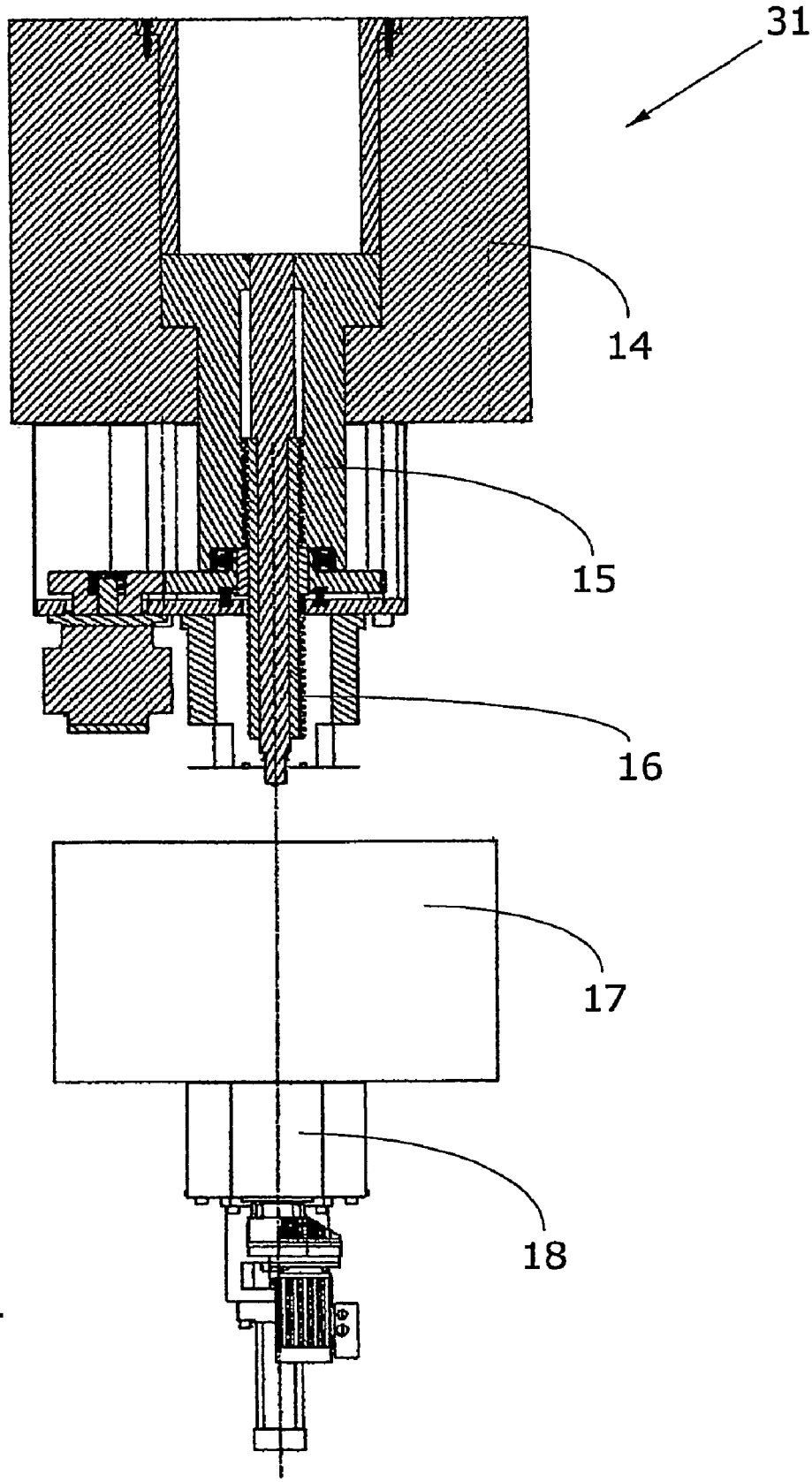
FIG. 2 shows an elevated front view partially in cross-section of a hydraulic press which together with other identical or similar hydraulic and/or mechanical presses form a work centre for carrying out the procedures according to the invention.

As can be seen in FIG. 2, one station 31 of the machining centre consists of a block 14 housing a hydraulic piston 15 which carries out the pressing operation. Inside the hydraulic piston 15 is an extraction piston 16 facing a die bed 17.

The lower part of the die bed 17 is equipped with an extraction unit 18 designed to move the blanks.

Figure 3:
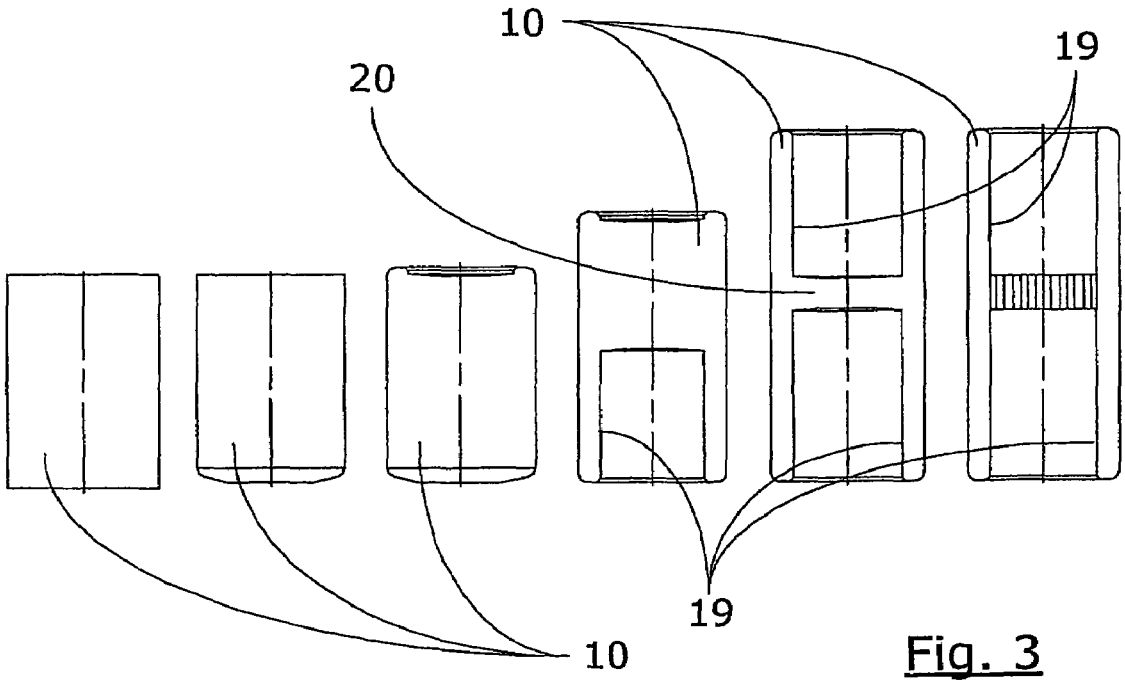
FIG. 3 represents an elevated front view of the progressive configuration of a bushing during the pressing stage.

With reference to FIG. 3, the blank to be machined 10, is gradually deformed (represented in the figure from left to right) in order to form two longitudinally opposite dead holes 19 separated by a transverse section or plug 20 which can subsequently be removed by means of a drilling unit (not shown in the drawings).

The invention is described above with reference to a particular form of embodiment, consisting of the pressing of tubular metal elements, such as bushings, nuts or other elements with dead or through holes or the like.

It is nevertheless clear for the technical expert that the plant as described above can easily be adapted to obtain full pieces such as screws, or special shape extruded or pressed products, and to obtain any standard shape extruded or pressed products, whether drilled or sheared, according to machining requirements, which follow the construction specifications dictated by the various international standards for fasteners or fixing systems such as for example the DIN, ISO, ASTM, ANSI/ASME, JIS and SAE standards, etc., and in general to any mechanical element that can be cold pressed or extruded on the basis of a drawing provided by the customer and with a diameter indicatively greater than 30 mm.

The invention claimed is:

1. A procedure for the cold processing of tubular metal elements or other elements with dead or through holes, nuts, comprising the following machining steps:

(a) preparing a blank of full metal material from rolls;

(b) straightening the full metal material after unrolling from the skein;

(c) cutting the metal material into pieces of a determined length;

(d) passing each piece sequentially through a plurality of work stations of a work centre comprising several cold hydraulic presses in order to obtain a blank element presenting one or two longitudinally opposite dead holes separated by a central transverse section, wherein each piece is first cold machined by a hydraulic press, then extracted from said hydraulic press by means of a suitable manipulator robot and conveyed to an adjacent hydraulic press for a subsequent cold machining operation; and (e) through drilling the blank to remove the central traverse section;

wherein the metal elements have a diameter greater than 30 mm.

2. The procedure according to claim 1, wherein previously washed metal material is straightened by loading it on a wire-straightening unit designed to unroll the skein.

3. The procedure according to claim 2, in which the free end of the roll is pulled through a first set of rollers and then through a system of opposite rollers designed to straighten the wire and transfer it to a cutting unit.

4. The procedure according to claim 1, wherein the work centre comprises a series of hydraulic presses of various sizes and power levels connected by a transfer unit designed to move the pieces being machined.

5. The procedure according to claim 4, wherein the transfer unit consists of a series of gripper units powered by an appropriate source of energy.

6. The procedure according to claim 1, wherein the drilling is carried out by a special unit consisting of a vertical press.

7. The procedure according to claim 6, wherein this vertical press consists of a mechanical press.

8. The procedure according to claim 4, wherein the functioning and synchronisation of the individual presses and of the transfer unit are controlled by a PLC or a microprocessor.

9. The procedure according to claim 3, in which the material is cut into pieces of a predetermined length, advantageously by various possible procedures by means of one or mobile blades or by a circular saw.

10. The procedure according to claim 1, wherein the drilling is carried out by a special unit consisting of a vertical press.

11. The procedure according to claim 10, wherein this vertical press consists of a mechanical press.

12. The procedure according to claim 4, wherein functioning and synchronisation of the individual hydraulic presses and of the transfer unit are controlled by a PLC or a microprocessor.

13. A procedure for the cold processing of metal elements, comprising the following machining steps:

(a) preparing a blank of full metal material in the form of bars, which bars are loaded in bundles in a bar sectioning plant;

(b) cutting the metal bars into pieces of a determined length after being presented from the bar sectioning plant; and (c) passing each piece sequentially through a plurality of work station of a cold multi-hydraulic-press plant in order to obtain a finished element with or without swarf or waste, wherein each piece if first cold machined by a hydraulic press, then extracted from said hydraulic press by means of a suitable manipulator robot and conveyed to an adjacent hydraulic press for a subsequent cold machining operation;

wherein the metal elements have a diameter greater than 30 mm.

14. The procedure according to claim 13, wherein the products undergo shearing which can be carried out by means of a mechanical press.

15. The procedure according to claim 13, wherein the bars are presented at the cutting station in a synchronized way according to the needs of a machining centre consisting of the presses.

16. The procedure according claim 15, in which the material is cut into pieces of a predetermined length.

17. The procedure according to claim 13, characterised in that a plant or machining centre consists of a series of hydraulic presses of various sizes and power levels connected by a transfer unit designed to move the pieces being machined.

18. The procedure according to claim 17, wherein the transfer unit consists of a series of gripper units powered by an appropriate source of energy.

19. A procedure for the cold processing of tubular metal elements or other elements with dead or through holes, nuts, comprising the following machining steps:

(a) preparing a blank of full metal material from rolls, wherein setting up and preparation of the full blank differs according to the metal material used;

(b) straightening the full metal material after the material is unrolled from the skein;

(c) cutting the metal material into pieces of a determined length;

(d) passing each piece sequentially through a plurality of work stations of a work centre comprising several cold hydraulic in order to obtain a blank element presenting one or two longitudinally opposite dead holes separated by a central transverse section, whereby each piece is first cold machined by a hydraulic press, then extracted from said hydraulic press by means of a suitable manipulator robot and conveyed to an adjacent hydraulic press for subsequent cold machining operation; and (e) through drilling the blank to remove the central traverse section;

wherein the metal elements have a diameter greater than 30 mm.

20. The procedure according to claim 19, carried out on material consisting of stainless steel, wherein the stainless steel is initially treated by solution annealing and pickled in a balanced solution of sulphuric acid, hydrofluoric acid, potassium permanganate and hydrogen peroxide, and subsequently washed repeatedly by means of immersion in a salting tank in order to facilitate the pressing.

21. The procedure according to claim 19, carried out on material consisting of low-alloy steel, wherein this material is pickled in sulphuric acid and subsequently washed in a phosphating tank in which, by chemical reaction, a layer of zinc phosphate is created on the surface of the piece, then immersed in a sodium stearate tank where, again by chemical reaction, a thin layer of zinc stearate forms on top of the previous layer of zinc phosphate.

22. A plant for the implementation of a procedure for the cold processing of tubular metal elements or other elements with dead or through holes, nuts, comprising the following machining steps:

(a) preparing a blank of full metal material from rolls;

(b) straightening the full metal material the material is unrolled from the skein;

(c) cutting the metal material into pieces of a determined length;

(d) passing the pieces sequentially through a plurality of work stations of a work centre comprising several presses in order to obtain a blank element presenting one of two longitudinally opposite dead holes separated by a central transverse section; and (e) through drilling the blank by removal of this central traverse section;

wherein the metal elements having a diameter greater than 30 mm, wherein the plant comprises a series of cold hydraulic presses adjacent to each other, designed to carry out a successive series of pressing operation on pieces to be machined wherein each piece is first cold machined by a hydraulic press, then extracted from said hydraulic press by means of a suitable manipulator robot and conveyed to and adjacent hydraulic press for a subsequent cold machining operation.

23. The plant according to claim 22, wherein the plant also comprises a drilling or shearing station.

24. The plant according to claim 23, wherein this drilling or shearing station consists of a vertical mechanical press.

25. A procedure for the cold processing of metal elements, comprising the following machining steps:

(a) preparing a blank of full metal material in the form of bars, which bars are loaded in bundles in a bar sectioning plant, in which the setting up and preparation of the full blank differs according to the metal material used;

(b) cutting the metal bars into pieces of a determined length; and (c) passing each piece sequentially through a plurality of work station of a cold multi-hydraulic-press plant in order to obtain a finished element with or without swarf or waste, wherein each piece is first cold machined by a hydraulic press, then extracted from said hydraulic press by means of a suitable manipulator robot and conveyed to an adjacent hydraulic press for a subsequent cold machining operation;

wherein the metal elements have a diameter greater than 30 mm.

26. The procedure according to claim 25, carried out on material consisting of stainless steel, wherein the stainless steel is initially treated by solution annealing and pickled in a balanced solution of sulphuric acid, hydrofluoric acid, potassium permanganate and hydrogen peroxide, and subsequently washed repeatedly by means of immersion in a salting tank in order to facilitate the pressing.

27. The procedure according to claim 25, carried out on material consisting of low-alloy steel, wherein this material is pickled in sulphuric acid and subsequently washed in a phosphating tank in which, by chemical reaction, a layer of zinc phosphate is created on the surface of the piece, then immersed in a sodium stearate tank where, again by chemical reaction, a thin layer of zinc stearate forms on top of the previous layer of zinc phosphate.

28. A plant for the implementation of a procedure for the cold processing of metal elements comprising the following machining steps:

(a) preparing a blank of full metal material in the form of bars, which bars are loaded in bundles in a bar sectioning plant;

(b) cutting the metal bars into pieces of a determined length; and (c) passing the pieces sequentially through a plurality of work station of a multi-hydraulic-press plant in order to obtain a finished element with or without swarf or waste;

wherein the metal elements have a diameter greater than 30 mm, wherein the plant comprises a series of cold hydraulic presses adjacent to each other, designed to carry out a successive series of cold pressing operations on pieces to be machined wherein each piece is first cold machined by a hydraulic press, then extracted from said hydraulic press by means of a suitable manipulator robot and conveyed to an adjacent hydraulic press for a subsequent cold machining operation.

29. The plant according to claim 28, wherein the plant also comprises a drilling or shearing station.

30. The plant according to claim 29, wherein this drilling or shearing station consists of a vertical mechanical press.

* * * * *